United States Patent [19]

Cook et al.

[11] Patent Number: 4,696,179

[45] Date of Patent: Sep. 29, 1987

[54] AIR ASSIST MEANS FOR USE IN TRANSFERRING RELATIVELY FLAT OBJECTS

[75] Inventors: Steven T. Cook, Bellbrook; David K. Wynn, Dayton, both of Ohio

[73] Assignee: Dayton Reliable Tool & Mfg. Co., Dayton, Ohio

[21] Appl. No.: 826,635

[22] Filed: Feb. 6, 1986

[51] Int. Cl.[4] ..... B21J 13/08

[52] U.S. Cl. ..... 72/405; 72/346; 72/427; 406/85; 406/108; 413/45

[58] Field of Search ..... 72/405, 427, 345, 361, 72/346; 406/85, 108, 86, 76, 73, 12; 413/45

[56] References Cited

U.S. PATENT DOCUMENTS

| | | | |
|---|---|---|---|
| Re. 29,645 | 5/1978 | Kaminski | 72/405 |
| 2,801,884 | 8/1957 | Friedman | 406/108 |
| 3,387,543 | 6/1968 | Beckers | 72/339 |
| 3,537,291 | 11/1970 | Hawkins . | |
| 3,874,740 | 4/1975 | Hurd | 198/268 |
| 3,953,076 | 4/1976 | Hurd . | |
| 4,096,731 | 6/1978 | Uehlinger et al. | 406/85 |
| 4,364,255 | 12/1982 | Byrd . | |
| 4,382,737 | 5/1983 | Jensen et al. | 72/405 |
| 4,554,814 | 11/1985 | Grow et al. | 72/405 |
| 4,561,280 | 12/1985 | Bachmann et al. | 72/405 |

FOREIGN PATENT DOCUMENTS

| | | | |
|---|---|---|---|
| 54101 | 2/1967 | German Democratic Rep. | 406/108 |

*Primary Examiner*—Daniel C. Crane

*Attorney, Agent, or Firm*—Biebel, French & Nauman

[57] ABSTRACT

In a ram press for manufacturing shells for can ends, a relatively flat shell is transferred from a tooling station to a destination. The shell is supported at the first station from the upper tooling work surface, from which it is propelled in edgewise fashion into a transfer path. The transfer path is at least partially enclosed and extends from an entrance adjacent the first station tooling toward the shell destination. An air assist mechanism is provided for acting upon the shell moving into and along the path, and includes an outlet conduit connected to a supply of air under pressure. The conduit includes an open outlet end. A valve is disposed the outlet conduit for controlling flow of air along said conduit. The outlet conduit is disposed with its outlet end at one side of the entrance to the transfer path, with the end positioned in a direction into the path, whereby air is directed along said path in the direction of movement of the object. The air facilitates movement of the shell along the path.

19 Claims, 6 Drawing Figures

AIR ASSIST MEANS FOR USE IN TRANSFERRING RELATIVELY FLAT OBJECTS

BACKGROUND OF THE INVENTION

The present invention relates to apparatus for the transfer of relatively flat objects from a first to a second work station and, more particularly, to an air assist means that facilitates such transfer. The present invention is especially adapted for use within equipment for the manufacture of shells used to close the ends of metal cans.

One common way of packaging liquids, particularly beverages such as beer, soft drinks, juices and the like, is within cans typically formed from aluminum. In such cans, the can body is either manufactured to include both the can side walls and an attached bottom end, or the bottom end is formed separately and subsequently joined to the side walls. The upper end, which includes the means by which the can is opened, is manufactured separately and attached to the can body after the can has been filled.

The can ends, often referred to within the art as shells, are generally manufactured within ram presses. While various particular methods of shell formation are known and available, it is often necessary within these methods to transfer the shells from a first to a succeeding work station. In view of the large quantities of cans and shells that are manufactured, it is desirable to be able to form quantites of the shells very rapidly. This necessitates a transfer system that is both quick and reliable.

Various types of transfer systems for shells are known. In one approach, the shell is partially formed within the first tooling station and then positioned for transfer. A device is actuated to strike the shell with an edgewise blow that propels the shell outwardly from the tooling. The shell moves lateraly along a transfer path either out of the press for further processing, or arrives at a second station for additional operations.

An example of this type of transfer system may be seen in U.S. patent application Ser. No. 571,051, filed Jan. 16, 1984. There, a driver extends an actuator to provide the blow for moving the shell along the transfer path. Ideally, the shell moves in free flight without contacting the restraining structure defining the path until the shell is captured at the second station. Of course, any contact by the shell with the surrounding structure, for example as the result of unintentional variations in shell flight direction, will tend to slow the movement of the shell.

This system has been found to be quite reliable. However, particularly where a shall is being transferred into a second work station within the same press, speed and consistency in transfer times is of great importance. While it might be possible to provide detectors for determining the occasional late arrival of shells at the second station, there is no practical way of delaying operations in the station since such operations are under the control of the press drive. With the press typically running at speeds of at least several hundred strokes per minute, the timing of individual strokes cannot be altered. Thus, a late arriving shell could be subjected to forming or other work steps prior to proper positioning within the tooling. At best, this will result in a deformed work piece, but could also cause disruption of the manufacturing process requiring restarting of the press, lodged workpieces, or even damage to the press tooling itself.

A second example may be seen by reference to U.S. Pat. No. 4,554,814 issued to Grow et al. The shell is again struck with a physical blow to move it from the tooling. In this example, however, the shell is struck with a blow insufficient to move the shell the full distance along the path, and as the shell is propelled, it passes along a transfer surface. As part of the surface, a conduit is provided extending along the path and supplied with air under pressure. A series of slots or openings along the length of the path permit the air to emerge under pressure in a direction both upwardly and along the path so that the shell is conveyed along the path by the air emerging from the conduit.

The apparatus disclosed in Grow et al can be advantageous in that the initial impact need not be relied upon for the entire transfer movement of the shell. On the other hand, the transfer apparatus does not operate as quickly. Since the press and associated first station tooling cannot begin its next stroke until the shell has completely cleared the tooling, a longer time period is required between press strokes, thereby reducing the running speed of the press. Further, the conduit must be carefully formed and positioned within the tooling, thereby increasing the cost of the press.

It can be seen, therefore, that any improvement in the transfer mechanism for moving shells from a press tooling and directing them into a transfer path is advantageous. This is particularly the case where such improvements increase either speed or reliability of the transfer process.

SUMMARY OF THE INVENTION

In accordance with the invention, an improved system is provided for transferring flat objects, preferably shells, from a first tooling station located within a ram press. Specifically, an air assist means is provided as the improvement, with the transfer apparatus being any apparatus for transferring a relatively flat object from a first station to a destination. The transfer apparatus includes means for supporting the object at the first station, means defining an at least partially enclosed transfer path extending from an entrance adjacent the first station toward the destination, and means for propelling the object from the supporting means in edgewise fashion into the transfer path.

The air assist means acts upon the object moving along the path, and includes means for supplying air under pressure. An outlet conduit is connected to the supply means and defines an open outlet end. Valve means is disposed along the outlet conduit for controlling flow of air along the conduit, and control means selectively controls the valve means. The outlet conduit is disposed with the outlet end at the entrance to the transfer path, and with the end positioned in a direction into the path whereby air is directed along the path in the direction of movement of the object.

The transfer path is defined at least partially by a pair of opposing side walls. In such a case, the outlet conduit is disposed with its outlet end positioned adjacent one of the side walls. The outlet conduit defines a first cross-sectional area, and further may include a nozzle connected to the outlet end of the conduit, the nozzle defining a second cross-sectional area less than the first area.

The invention may be practiced in a ram press for manufacturing shells for can ends. The relatively flat shell is transferred from a first press tooling station to a destination. The press includes first tooling including an upper tooling having a work surface and a cooperating lower tooling. The shell is supported at the first station, and an at least partially enclosed transfer path is defined extending from an entrance adjacent the first station tooling toward the destination. Means is located at the first station for propelling the shell from the supporting means in edgewise fashion into the transfer path.

The air assist means for acting upon the shell moving into and along said path includes means for supplying air under pressure, an outlet conduit connected to the supply means and defining an open outlet end, valve means disposed along the outlet conduit for controlling flow of air along the conduit, and control means for selectively controlling the valve means. The outlet conduit is disposed with the outlet end at the entrance to the transfer path, and with the end positioned in a direction into the path whereby air is directed along the path in the direction of movement of the object.

The transfer path may be defined at least partially by a pair of opposing side walls. The outlet conduit is disposed with the outlet end positioned adjacent one of the side walls. The outlet conduit defines a first cross-sectional area, and a nozzle connected to the outlet end of the conduit. The nozzle includes a second cross-sectional area less than the first area.

The supporting means may include the upper tooling, the shell being supported along its upper surface from the working surface. The propelling means directs the shell into the path in substantially free flight.

The propelling means itself may include a housing, an actuator extending from the housing and connected thereto for selective further extension from and subsequent retraction toward the housing, and means for controlling the further extraction of the actuator in response to operation of the tooling means, whereby movement of the piston causes the actuator to strike a blow edgewise of the shell for propelling the shell into the transfer path. The control means is operative to cause air to flow out of the conduit only while a shell is present within the path, continuing until the shell arrives at the destination. The control means may be responsive to angular position of the press crank for controlling the valve means.

The destination for the shell may be a second tooling station within the press, the second station being physically separated from the first station. Alternatively, the destination may be a point of exit from the press.

Accordingly, it is an object of the present invention to provide means for facilitating and improving the edgewise transfer movement of a relatively flat object from a first station to a destination; to provide such a means that is secifically adapted to use with shell-forming apparatus; to provide such a means that increases both the reliability and the speed with which the shells can be transferred from the tooling station; to provide such a means that is usable for transfers either to a successive work station within the press or entirely out of the press; to provide such a means that may be used in conjunction with shell propelling devices presently in use; and to provide such a means that is relatively simple in design, easy to install and includes a minimum of moving parts.

Other objects and advantages of the invention will be apparent from the following description, the accompanying drawings, and the appended claims.

DETAILED DESCRIPTION OF THE PREFERRED EMBODIMENTS

Figure 1:
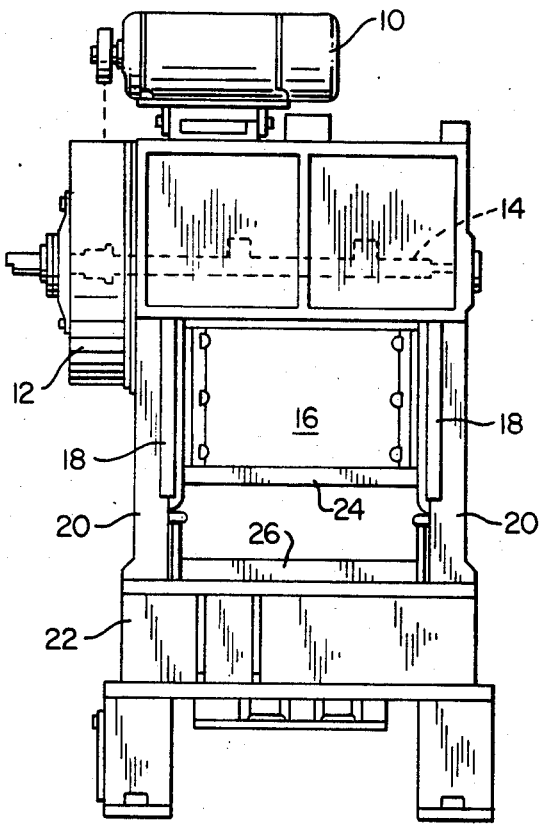
FIGS. 1 and 2 are, respectively, front and side views of a typical single-acting ram prss as utilized in the present invention.
Figure 2:
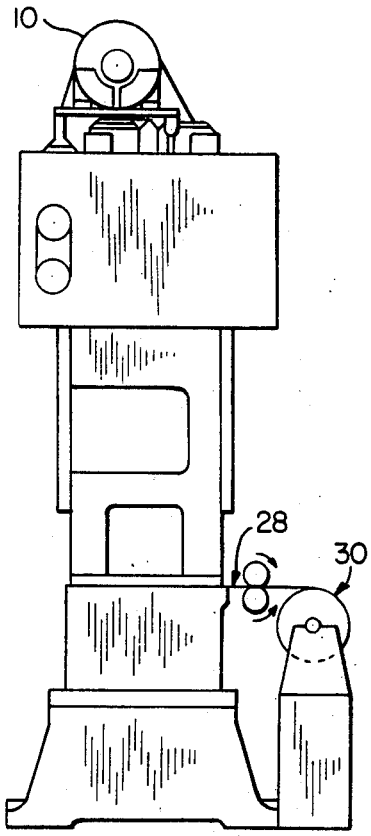

Referring now to the drawings, a typical ram press used in the manufacturing of shells for can ends is shown generally in FIGS. 1 and 2. The press includes a drive motor 10 coupled to a flywheel 12 on the press crankshaft 14 which reciprocates the ram 16 along jibs 18 that are mounted to posts 20 extending upwards from the press bed 22. Upper tooling is fixed at 24 to the bottom of ram 16, and cooperating lower tooling is fixed at 26 to the top of bed 22. The relatively thin metal stock 28 from which the shells are formed is fed incrementally from a roll 30 into the front of the press.

The present invention is not dependent upon any specific method of shell formation, so long as the shells are at least partially formed with the ram press and transferred from the forming tooling. Thus, any one of a variety of methods may be used. In one preferred method, a two-step process requiring two separate toolings for each shell to be formed is used. At the first tooling, a blank is punched from the sheet of stock material. Into the blank is formed a substantially flat central panel and an upwardly extending chuckwall about the edge of the panel to produce a partially formed shell. The partially formed shell is then transferred to a second tooling within the same press, where the shell is captured and located. At this tooling, a countersink is formed into the shell at the base of the chuckwall by moving the panel upward relative to the chuckwall to produce a completed shell. This method and the necessary apparatus are described in detail in commonly-assigned U.S. Pat. No. 4,561,280 of Bachman et al, issued Dec. 31, 1985, which is hereby incorporated by reference.

However, it is not necessary that the two-step method disclosed in the above-reference patent be used. For example, a method in which the forming that occurs within the press take place at only a single station would also be appropriate, as is shown in either U.S. Pat. No. 4,382,737 of Jensen et al, or U.S. Pat. No. 3,537,291 of Hawkins. With such a method, finishing of the shells is performed following their ejection from the press.

Figure 3:
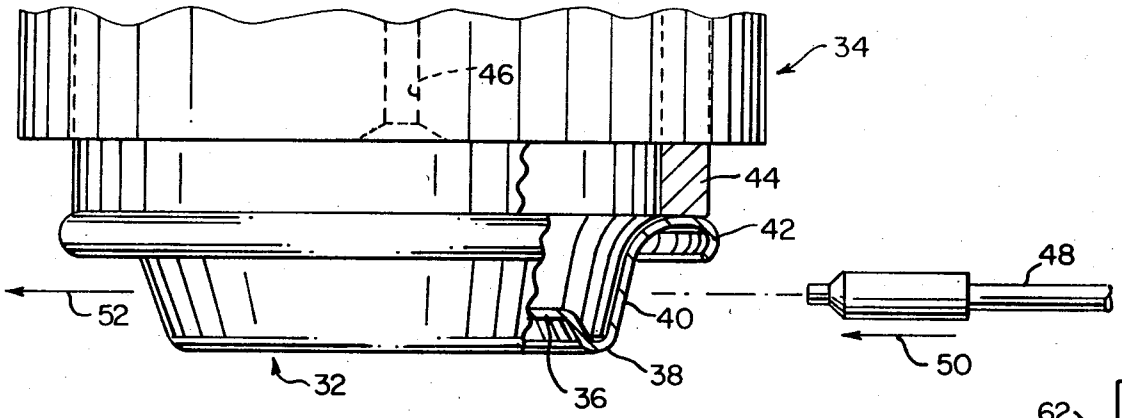
FIG. 3 is an enlarged side view of the lowermost portion of an upper tooling, showing positioning of a shell for transfer from the tooling.

Regardless of the method by which the shell is either completely or partially formed within the ram press, the shell is transferred from the former tooling within the press by striking the shell with an edgewise blow so as to propel the shell from the tooling in an edgewise, horizontally oriented fashion. Referring now to FIG. 3, a shell 10 is shown supported from the upper tooling 34 of a tooling set. Tooling 34 is in turn supported for operation from the press ram (not shown).

Discussing briefly the shell itself, as shown in FIG. 3, it should be recognized that while the general overall shape of the shell is typical, the specific dimensional relationships and thickness of the shell material may differ significantly from that shown and, in any event, are shown sustantially enlarged for purposes of clarity. The shell is an integral metal part, formed from a suitable metal blank which may be punched from stock material during that portion of the forming operation carried out within the ram press. As part of operations within the press upon the blank, the shell 32 is formed to provide a flat central panel 36, a countersunk reinforcing area 38 extending into a relatively straight upward and outward shaped chuckwall 40, and a lip or curl edge portion 42. Lip 42 is designed to cooperate with a curled portion at the upper edge of a can body, so that the shell may be later seamed to the can body to produce a sealed container.

It should be understood that shell 32 is shown in a substantially completed form. Where a two-step formation method is used, as in the above referenced Bachmann et al patent, a somewhat differently appearing shell will be produced at the first tooling. The shell will nontheless be generaly flat, and may be transferred to the second tooling station by a transfer mechanism substnatially identical to that used to transfer completed shells from the press.

Tooling 34 is provided to carry out, in cooperation with a corresponding lower tooling (not shown), at least a portion of the various forming steps so that a metal blank may be configured into the shell 32 shown in FIG. 3. As one portion of tooling 34, a positioner ring 44 is located within the tooling. After shell formation, the tooling is raised to the open position shown in FIG. 3. As the tooling is raised, the completed shell 32 is carried upwardly within the tooling. The shell is held for such movement by either a friction fit within the tooling, or by appication of vacuum to the working surfaces of the tooling, for example, through vacuum passageway 46, or both. As the tooling is raised, the positioner ring 44 approaches and contacts an appropriate stop mechanism (not shown) that halts upward movement of positioner ring 44 while the remainder of tooling 34 continues its upward movement. Positioner ring 44 then contacts the upper portion of lip 42 of shell 32. Since vacuum continues to be applied to the shell, it is adhered to the positioner ring 44 and remains stationary during the remaining upward stroke of the press.

Once positioned as shown in FIG. 3, the shell 32 is now ready to be transferred either to a subsequent tooling station or out of the press. The basic preferred mechanism through which shell transfer occurs is the striking of chuckwall 40 of shell 32 with a sharp blow. The blow is produced by the rapid extension of an actuator 48 which advances toward shell 32 in the direction indicated by arrow 50. As shell 32 is struck, it is propelled from tooling 34 in the direction indicated by arrow 52.

Figure 4:
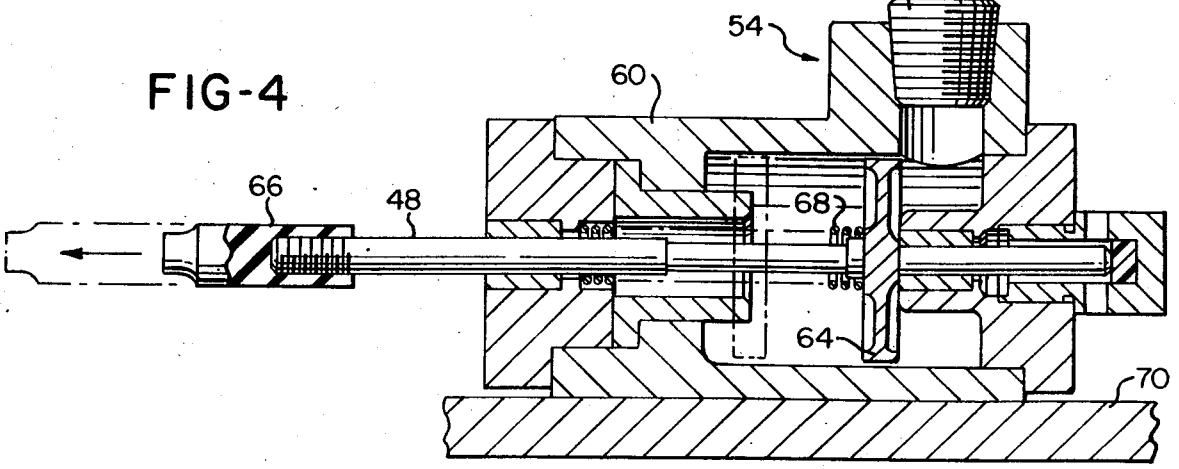
FIG. 4 is a cross-sectional view of a shell propelling driver.

Operation of actuator 48 is caused by a driver 54 which is shown in detail in FIG. 4. Driver 54 includes the actuator 48 which is in the form of an elongated shaft extending from the driver body toward the corresponding tooling set. An air valve 56 is associated with driver 54, and is adapted to selectively apply compressed air through air line 58 from a standard shop compressed air supply to driver 54 at typical pressures of 50 to 60 psi. As will be described in detail below, application of compressed air at the appropriate time to driver 54 causes actuator 48 to extend further from the driver housing. Valve 56 may be any appropriate relatively quick-actin valve, and is preferably a direct-acting solenoid valve such as those manufactured by Schrader Bellows Division of Scovill Mfg. Co. of Akron, Ohio. The valve 56 is selected so that when the air supply is not connected to driver 54, the driver interior is permitted to exhaust to the atmosphere.

Driver 54 includes an exterior housing 60. An opening through housing 60 into the interior thereof is provided with an appropriate fitting 62 for connection to the valve 56. A piston 64 is disposed within the interior of housing 60 for movement therealong, and is attached to actuator shaft 48 extending through one end of housing 60. Preferably, piston 64 and actuator shaft 48 are integrally formed as a single piece.

As compressed air is delivered to the interior of housing 60 through fitting 62, the resulting air pressure causes movement of piston 64 so as to result in outward extension of actuator 48. Due to the relative light weight of piston 64 with respect to the pressure of the incoming air, movement of piston 64 occurs sufficiently rapidly to propel a shell away from the tooling. For example, when constructed according to the preferred ebmodiment, an average velocity is imparted to the shell typically in the order of 244 inches/sec. (610 cm/sec.), the piston 64 need not fit in an airtight relationship within housing 60. Some degree of "leakiness" or bypass of air around piston 64 can be tolerated wtihout adversely affecting the performance of driver 54. In fact, it is preferred that the piston 64 fit only loosely within housing 60, having a piston surface area less than the area of the cross-section of the interior of housing 60. In such a case, no seals are required on piston 64, reducing potential for sticking and increasing tolerance to contaminants (such as water or oil) carried within the compressed air supply.

To prevent damage to the shell from contact with actuator 48, a tip member 66 formed of an elastomeric material is secured to the distal end of actuator 48. Additionally, a spring 68 is placed about actuator 48 between piston 64 and the end of housing 60, to return piston 64 to its original location, following closure of valve 56 and discontinuation of the supply of compressed air to driver 54. Appropriate vent holes (not shown) may be provided through housing 60 to relieve at least part of the air pressure created within housing 60 as piston 64 is moved.

Housing 60 is in turn mounted in a fixed position with respect to the press bed, for example, by connection to a mounting plate 70 by appropriate clamping means (not shown). Plate 70 is in turn supported by the press bed.

Figure 5:
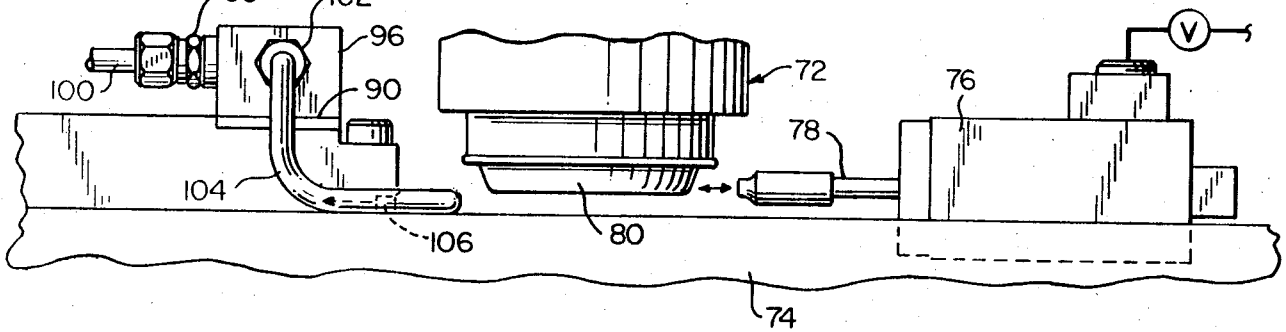
FIG. 5 is a side view of a first tooling station and entrance into the transfer path, showing the air assist mechanism of the present invention.

Referring now to FIG. 5, a transfer mechanism is shown for moving a partially completed shell from a first station tooling into a transfer path for delivery to a second tooling station where formation is completed. Only upper tooling 72 is shown, it being understood that the cooperating lower tooling is disposed beneath bare plate 74 with toolin 72 lowered by the press ram through an opening (not shown) in the base plate. A driver 76 is positioned adjacent tooling 72, so that extension of actuator 78 will cause the actuator to strike a shell 80 positioned on the lower, working surface of tooling 72.

Figure 6:
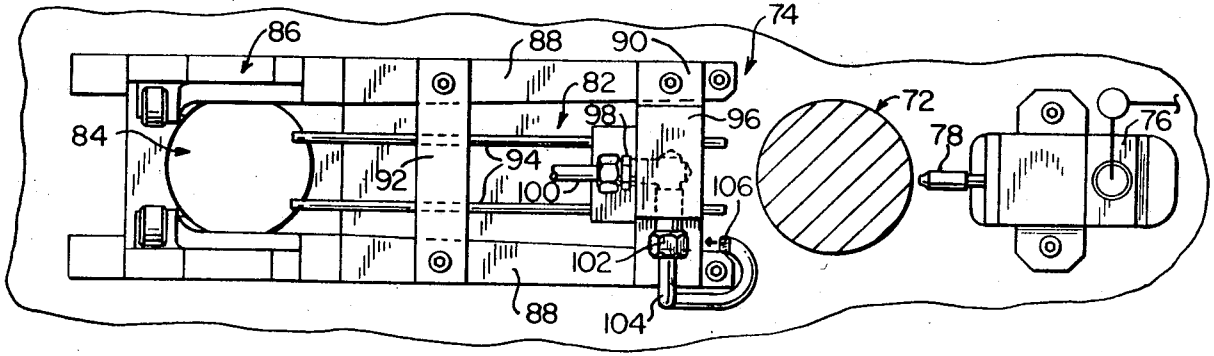
FIG. 6 is a schematic plan view of the first station, transfer path, and a second station, along with the air assist mechanism.

Referring also to FIG. 6, the struck shell 80 will be propelled in substantially free flight into the entrance to a transfer path 82 leading to a second tooling station 84. There, the shell is captured and located with an appropriate capturing mechanism 86 prior to being operated upon by the second station tooling. Details of the capturing mechanism 86 may be seen by reference to U.S. Pat. No. 4,561,280, which has been incoporated hereinto by reference.

Transfer path 82 is partially enclosed, and is defined by a pair of side walls 88 mounted to base plate 74. A pair of cross members 90 and 92 are connected between walls 88, and a pair of polished rails 94 are connected to the underside of each member 90 and 92 to define a top for the transfer path. Because the shell is propelled to travel substantially in free flight along the path, walls 88, plate 74 and rails 94 are provided only to occasionally guide a shell and to prevent shells from inadvertently leaving the transfer path. Normally, a shell does not travel in contact with these surfaces.

A typical length for transfer path 82 from the first station tooling to the second station tooling is in the order of approximately 10 to 30 inches (25 to 75 cm).

A valve 96 extends upwardly from plate 90 above and near the entrance to transfer path 82. A fitting 98 is threadingly engaged into an inlet for valve 96 and connects with a conduit 100 extending away from the transfer path. Conduit 100 connects with a source of compressed air, preferably a source of 40 to 50 p.s.i. (2.8 to 3.5 kg/cm$^2$). Valve 96 may be any appropriate quick-acting valve for controlling compressed air flow, but is preferably electrically actuated to permit valve 96 to be connected into the overall press control system.

A fitting 102 is threadingly engaged into an outlet for valve 96, and connects with an outlet conduit 104 extending downwardly along the exterior of one side wall 88. Conduit 104 curves around the end of wall 88 to the entrance to transfer path 82, where conduit 104 terminates in an open end. At the open end, a nozzle 106 is formed consisting preferably of simple a flattened portion of conduit for focusing the air emerging from the conduit. Nozzle 106 is positioned adjacent the inner surface of wall 88 and against base plate 74, and is directed down path 82 in the direction of shell movement.

Valve 96 is actuated to permit air flow through conduit 104 just after a shell has entered into the transfer path 82, and air flow is continued until the shell has completed its movement along the path to the second tooling station. It has been found that the air supplied in such a manner provides a pushing force behind the shell as the shell effectively rides the air stream, as well as some turning motion to the shell as a result of the application of air at one side of the transfer path. Further, it is believed that the conduit 104 provides an air cushion upon which the shell is at least partially supported. These effects have been found to be beneficial in facilitating shell movement along path 82 for transfer. Specifically, shell speed is increased, and the direction of the moving shell is more closely regulated to decrease contact with the structure defining the transfer path.

Nozzle 106 may, of course, be positioned adjacent either of side walls 88. Further, while not preferred, nozzle 106 could be located more toward the center of the transfer path to provide some assistance to the shell transfer, although such location will decrease the rotational movement imparted to the shell. Multiple nozzles 106 can be used at the path entrance, but are not needed and therefore are not preferred from the standpoint of maximum simplicity and minimal parts. Further, it should be noted that the air assist mechanism disclosed herein eliminates any need to extend an air conduit having multiple openings along the transfer path.

The transfer mechanism as shown in FIGS. 5 and 6, including the air assist means, is specifically adapted to carry out the transfer of a shell from a first station tooling to a second station tooling within the same press. Of course, the present invention is not limited solely for such a transfer, but rather can be used for any shell transfer, or for transfers of other relatively flat objects moving in edgewise fashion. In a shell press having a two-stage tooling arrangement, such as that shown in FIGS. 5 and 6, it is anticipated that a similar air assist mechanism will be used in conjunction with the shell transfer mechanism moving shells from the second station tooling station out of the press.

It should also be noted that the air assist mechanism can be used with drivers other than that specifically described herein. For example, purely mechanical shell strikers operating through a cam arrangement linked to the press drive would be usable, as well as any other propelling means that causes the shells to move in edgewise fashion along the transfer path.

Valve 96 is preferably controlled with the general control system used for the shell-forming apparatus. Such a system is generally described in the previously referenced U.S. Pat. No. 4,561,280. Press functions are controlled by a programmable rotary position switch that provides a variety of separate switching functions, each of which may be adjusted to open and close switching contacts at predetermined angular positions of the press crank. The electrically operated functions of the press are directed by a microprocessor which interfaces with both operator actuated controls and the rotary position switch. The microprocessor is programmed to control various press functions in proper timing and sequence.

The initiation of air flow by actuation of valve 96 is timed to commence just after the shell has entered the transfer path. Air cannot be continuously maintained, since a shell entering the path would then pass through the turbulent region near the air nozzle. This would slow the shell to such an extent as to negate any benefit from the air assist means. It has been found sufficient to actuate valve 96 between 5° and 20° of crank rotation after actuation of the driver propelling the shell from the tooling.

Once valve 96 has been actuated, it is not deactuated until the rotary position switch, and hence the press crank, has moved 85°. This has been found to be sufficient to provide air assistance for the entire transfer of the shell along a 15" (38 cm) path. At a typical press speed of 360 strokes per minute, this results in air flow from nozzle 106 having a duration of approximately 39 milliseconds.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. In an apparatus for transferring a relatively flat object from a first station to a destination, including:

means for supporting and operating on the object at the first station;

said supporting means supporting the object from an upper surface thereof;

means defining an at least partially enclosed transfer path extending from an entrance adjacent said first station toward said destination; and means for propelling the object from said supporting means in edgewise fashion into said transfer path, wherein said propelling means directs the object into said path in substantially free flight;

the improvement comprising air assist means for acting upon the object moving into and along said path, said assist means including:

means for supplying air under pressure;

an outlet conduit connected to said supply means and defining an open outlet end;

valve menas disposed along said outlet conduit for contolling flow of air along said conduit; and control means connected to said valve means for selectively controlling said valve means in response to operation of said first station so that said valve means is actuated to supply air to the transfer path just after each flat object has entered the enclosed transfer path;

said outlet conduit being disposed with said outlet end at said entrance to said transfer path, and with said end positioned in a direction into said path whereby air is directed along said path in the direction of movement of the object.

2. Apparatus as defined in claim 1, wherein said transfer path is defined at least partially by a pair of opposing side walls.

3. Apparatus as defined in claim 2, wherein said outlet conduit is disposed with said outlet end positioned adjacent one of said side walls.

4. Apparatus as defined in claim 1, wherein said outlet conduit defined a first cross-sectional area, and further comprising a nozzle connected to said outlet end of said conduit, said nozzle defining a second cross-sectional area less than said first area.

5. Apparatus as defined in claim 1, wherein said transfer path is defined at least partially by a pair of opposing side walls.

6. Apparatus as defined in claim 5, wherein said outlet conduit is disposed with said outlet end positioned adjacent one of said side walls.

7. In a ram press for manufacturing shells for can ends in which a relatively flat shell is transferred from a first press tooling station to a destination, the press including:

first tooling including an upper tooling having a work surface and a cooperating lower tooling;

means for supporting the shell at said first station, wherein said supporting means includes said upper tooling, the shell being supported along its upper surface from said working surface;

means defining an at least partially enclosed transfer path extending from an entrance adjacent said first station tooling toward said destination; and means located at said first station for propelling the shell from said supporting means in edgewise fashion into said transfer path, wherein said propelling means directs the object into said path in substantially free flight;

the improvement comprising air assist means for acting upon the shell moving into and along said path, said assist means including:

means for supplying air under pressure;

an outlet conduit connected to said supply means and defining an open outlet end;

valve means disposed along said outlet conduit for controlling flow of air along said conduit; and control means connected to said valve means for selectively controlling said valve means in response to operation of said upper and lower tooling so that said valve means is actuated to supply air to the transfer path just after each flat shell has enterred the enclosed transfer path;

said outlet conduit being disposed with said outlet end at said entrance to said transfer path, and with said end positioned in a direction into said path whereby air is directed along said path in the direction of movement of the object.

8. The ram press as defined in claim 7, wherein said supply means supplies compressed air at a pressure in the range of approximately 40 to 50 p.s.i. (2.8 to 3.5 $kg/cm^2$).

9. The ram press as defined in claim 7, wherein said transfer path is defined at least partially by a pair of opposing side walls.

10. The ram prses as defined in claim 9, wherein said outlet conduit is disposed with said outlet end positioned adjacent one of said side walls.

11. The ram press as defined in claim 10, wherein said transfer path is further defined by a base plate extending between said side walls at the lower edges thereof.

12. The ram press as defined in claim 11, wherein said outlet conduit is disposed with said outlet end positioned adjacent both one of said side walls and said base plate.

13. The ram press as defined in claim 7, wherein said outlet conduit defined a first cross-sectional area, and further comprising a nozzle connected to said outlet end of said conduit, said nozzle defining a second cross-sectional area less than said first area.

14. The ram press as defined in claim 13, wherein said nozzle is defined by a flattened portion of said conduit disposed at said outer end.

15. The ram press as defined in claim 7, wherein said propelling means includes;

a housing;

an actuator extending from said housing and connected thereto for selective further extension from and subsequent retraction toward said housing;

means for controlling said further extension of said actuator in response to operation of said tooling means whereby movement of said piston causes said actuator to strike a blow edgewise of the shell for propelling the shell into said transfer path.

16. The ram press as defined in claim 7, wherein said control means is operative to cause air to flow out of said conduit following passage of the shell past said open end and until the shell arrives at said destination.

17. The ram press as defined in claim 16, wherein said control means is responsive to angular position of the press crank for controlling said valve means.

18. The ram press as defined in claim 7, wherein said destination is a second tooling station within said press, said second station being separated from said first station.

19. The ram press as defined in claim 7, wherein said destination is a point of exit from the press.

* * * * *